US006305086B1

(12) United States Patent
Burgholzer

(10) Patent No.: US 6,305,086 B1
(45) Date of Patent: Oct. 23, 2001

(54) PIN CUTOFF TOOL

(75) Inventor: Bruce L. Burgholzer, Montgomery, IL (US)

(73) Assignee: Lucent Technologies, Inc., Murray Hill, NJ (US)

( * ) Notice: Subject to any disclaimer, the term of this patent is extended or adjusted under 35 U.S.C. 154(b) by 0 days.

(21) Appl. No.: 09/360,555

(22) Filed: Jul. 26, 1999

(51) Int. Cl.[7] ..... B26B 17/00
(52) U.S. Cl. ..... 30/186; 30/135; 30/271
(58) Field of Search ..... 30/28, 134, 135, 30/175, 179, 186, 191, 254, 271

(56) References Cited

U.S. PATENT DOCUMENTS

| | | | | |
|---|---|---|---|---|
| 29,543 | * | 8/1860 | Baker | 30/186 |
| 483,869 | * | 10/1892 | Randle | 30/186 |
| 881,092 | * | 3/1908 | Broadbooks | 30/186 |
| 908,969 | * | 1/1909 | De Arment | 30/186 |
| 1,349,563 | * | 8/1920 | Day | 30/271 |
| 1,399,958 | * | 12/1921 | Gilbert | 30/186 |
| 3,091,853 | * | 6/1963 | Polayes | 30/271 |
| 3,352,010 | * | 11/1967 | Keller | 30/135 |

* cited by examiner

*Primary Examiner*—Hwei-Siu Payer
(74) *Attorney, Agent, or Firm*—James W Wiegard

(57) ABSTRACT

A pin cutoff tool employs shears to sever pins. The pin cutoff tool is formed in a pliers-like configuration, with working surfaces formed within the jaws, and a pair of handles situated in working arrangement opposite a pivot point to provide leveraging advantage to the shearing surfaces. Stops may be formed within the jaws to limit the amount of closing travel, and to limit the amount of opening travel. The closing stops also may be formed such that, when closed, the inner surfaces of the jaws are substantially equal to the width of a pin being cut. Grooves may be formed in the jaws to accommodate neighboring, closely situated pins, and the jaws may be relatively narrow, so that neighboring pins in a direction orthogonal to the axis of the channels are not disturbed by the tool when shearing a pin.

16 Claims, 4 Drawing Sheets

PIN CUTOFF TOOL

FIELD OF THE INVENTION

The invention relates to tools used for repairing electronic systems, and, in particular, to electronic pin cutoff tools.

BACKGROUND OF THE INVENTION

Just as electronics systems are ubiquitous in the modern world, conductive pins used to carry signals are ubiquitous in electronic systems. Conductive pins may extend from a printed circuit board, such as a personal computer "motherboard", where they may be employed as "jumpers" to effect semi-permanent electronic configuration settings, for example. Additionally, such pins are also frequently employed on the backplanes of an electronics systems' card cage. The backplane is itself typically a printed circuit board whose conductive traces interconnect the various signal lines brought into the backplane's edge connectors from the electronics cards plugged into the backplane's edge connectors. That is, printed circuit boards housing system electronics and fitted with edge connectors plug into connectors on such backplanes. On the opposite side of the backplane from the edge connectors, protruding conductive pins make electrical connection with the signal lines within the backplane edge connector, thereby "bringing out" these signals to the back side of the backplane. These conductive pins are typically arranged in an array of closely spaced rows and columns and are used, for example, to test and monitor the electronics housed within the card cage.

Sometimes, in order to repair or otherwise modify the electronics system, these pins must be removed. Specialized tools, pin cutoff tools, are used to cut the pins. Pin cutoff tools typically are of a pliers-like construction, having handles which, when forced together, apply a leveraged force to pincer tips on the opposite side of a pivot point from the handles. When closed over a pin, the pin is cut off by the pinching action of the pincer tips.

Because the pins are typically positioned very close to one another on the circuit board, getting the pin cutoff tool properly positioned is a difficult proposition. Consequently, neighboring pins are often inadvertently bent or broken, thus requiring their own replacement and compounding the problem that the pin cutoff tools was intended to solve. Additionally, since a great deal of force must be brought to bear in order to clip the pins off in the pincer tips, the pins often fly off, caroming into sensitive electronics equipment.

A pin cutoff tool that cuts targeted pins without damaging neighboring pins, and that does so while substantially reducing the likelihood that a cut pin will be ejected into neighboring electronics equipment would therefore be highly desirable.

SUMMARY

A pin cutoff tool in accordance with the principles of the present invention employs shears, rather than pincers, to sever pins. The pin cutoff tool is formed in a pliers-like configuration, with working surfaces formed within the jaws, and a pair of handles situated in working arrangement opposite a pivot point to provide leveraging advantage to the shearing surfaces. The shearing surface elements are arranged laterally, that is orthogonal to the lengthwise axis of the tool and parallel to the interior surfaces of the jaws.

In an illustrative embodiment stops are formed within the jaws of the tool to prevent over-travel. Additionally, a stop, such as a nut and bolt, or rivet, arrangement, may be employed to limit the amount which the jaws may be opened, thereby reducing the likelihood of damaging pins situated near the pin being trimmed. The jaws may be formed to have a relatively narrow opening such that, when closed, the sheared pin will be less likely to be ejected from the jaws of the tool than if the interior opening were wider. In another aspect of the invention, a substance may be applied to the interior surfaces of the jaws to further reduce the likelihood that the pin will be ejected. Such a substance may be a resilient, cushioning material, such as rubber or foam, and may also provide an adhesive surface to capture the sheared pins. Grooves may be formed in the jaws to accommodate neighboring, closely situated pins, and, to further facilitate the use of the tool in cramped quarters, the jaws may be relatively narrow, so that neighboring pins in a direction orthogonal to the plane of the channels are not disturbed

BRIEF DESCRIPTION OF THE DRAWINGS

The above and further features, aspects, and advantages of the invention will be apparent to those skilled in the art from the following detailed description, taken together with the accompanying drawings in which.

DETAILED DESCRIPTION

Figure 1:
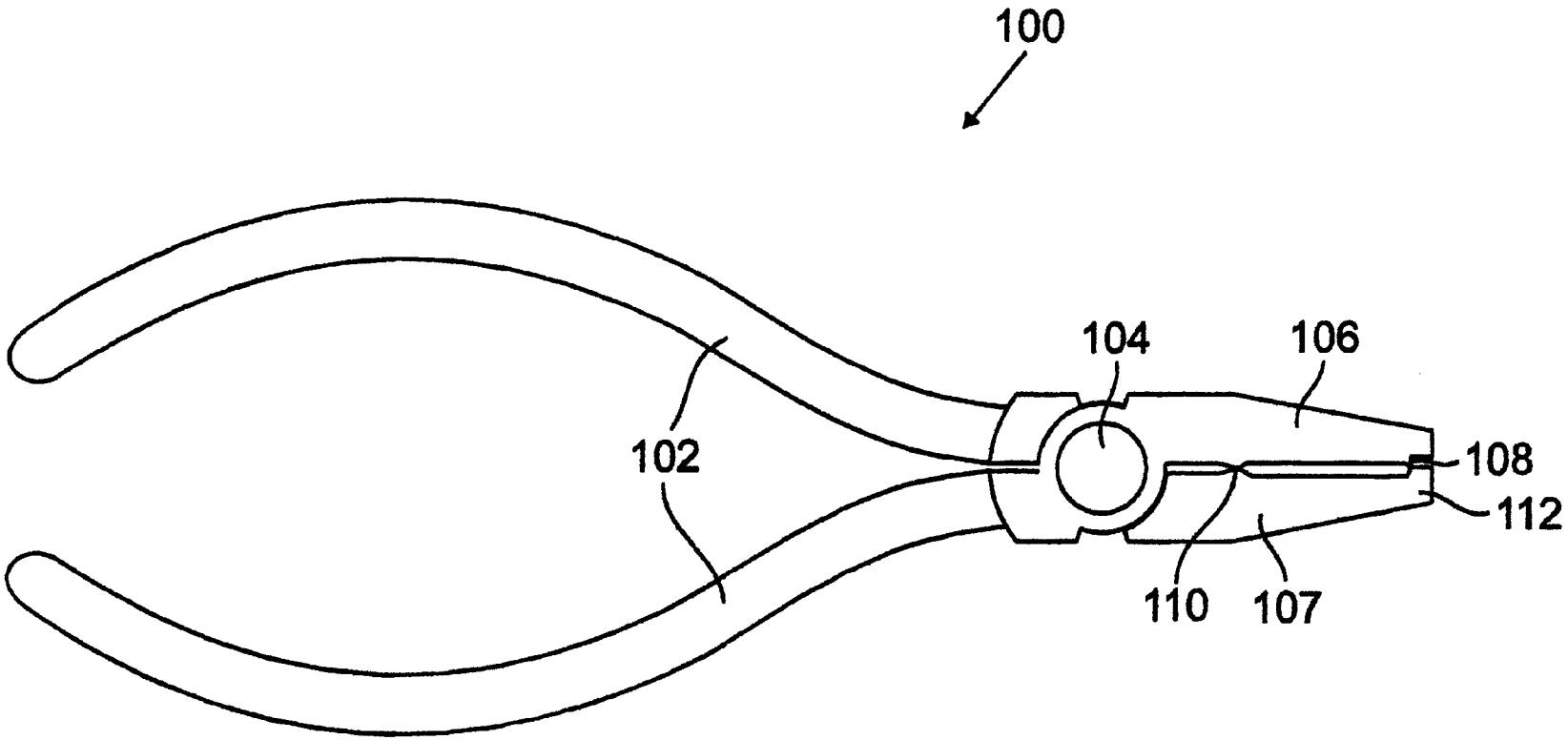
FIG. 1 is an elevation view of a pin cutoff tool in accordance with the principles of the present invention.

A pin cutoff tool in accordance with the principles of the present invention employs shears, rather than pincers, to sever pins. The pin cutoff tool is formed in a pliers-like configuration, with working surfaces formed within the jaws, and a pair of handles situated in working arrangement opposite a pivot point to provide leveraging advantage to the shearing surfaces. In an illustrative embodiment, stops are formed within the jaws of the tool to prevent over-travel. A travel stop may also be employed to limit the amount that the jaws may open, and an opening mechanism such as a spring may be included to force the jaws open in a resting position. The elevation view of FIG. 1 illustrates a pin cutoff tool 100 in accordance with the principles of the present invention. The pin cutoff tool 100 includes handles 102 in working arrangement opposite a pivot 104 from jaws 106. As will be described in greater detail in the discussion related to FIG. 2, the jaws 106 include working surfaces in the form of shears 108. Stops 110 are also situated within the jaws to limit the amount of closing travel available to the jaws. Limiting the closing travel in this manner reduces the likelihood that a sheared pin will fly off wildly into the neighboring electronics and prevent the shears from being unduly dulled by impinging on the jaws' opposing surfaces. The interior surfaces 112 of the jaws 106 are in close proximity to one another, again, to limit the likelihood of sheared pins being ejected in an undesirable fashion. In an illustrative embodiment, the distance A between the interior surfaces is substantially equal to the width of a pin targeted for cutting. Because the pins are typically a standard size, a tool with such an opening may be used to cut pins used in many different applications. In an illustrative embodiment, the cutoff tool, in particular, the shears 108, are of a hardened steel, rated at least 55 Rockwell hardness.

Figure 2:
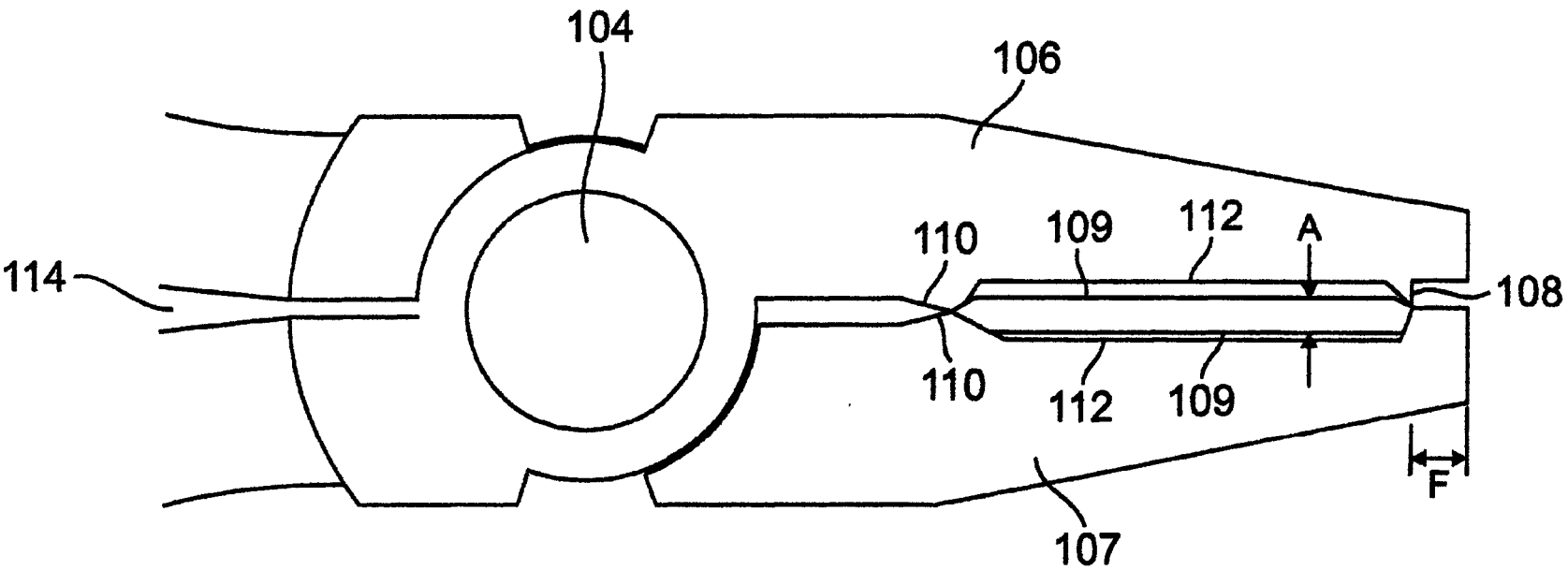
FIG. 2 is an enlarged view of the working surfaces inside the jaws of the pin cutoff tool of FIG. 1.

The enlarged view of FIG. 2 illustrates in greater detail the jaws 106. In particular, the shears 108 and the stops 110 are illustrated in a manner which reveals how the stops 110 prevent over-travel of the shears 108. Just as the upper shear member travels a sufficient distance to shear off a pin, the stops 110 prevent the upper shearing member 108 from further travel. In accordance with the principles of the invention, the distance A between the working surfaces of the jaws 106 may be substantially equal to the width of a pin that is being cut. With the inner surfaces of the jaws set substantially equal to the width of the pin to be sheared, the jaws tend to capture a pin before it has an opportunity to fly out from between the jaws and do damage to the surrounding electronics. A spring 114 may be attached to the handles of the tool to force the handles open, and the jaws open, in a resting position. Additionally, a resilient and/or adhesive material 109 may be affixed to the inner surfaces of the jaws to further diminish the likelihood that a sheared pin will be ejected from between the working surfaces of the jaws. The resilient material 109 may be applied to one or both of the inner surfaces 112 so that a pin being cut by the tool 100 is embraced by the material, thereby preventing the ejection of the pin when it is cut. The material may be a relatively hard rubber material, for example. Additionally, the shears 108 may be located a distance F from the tip of the jaws 106, the distance F being the desired length of a cut pin's stub.

Figure 3:
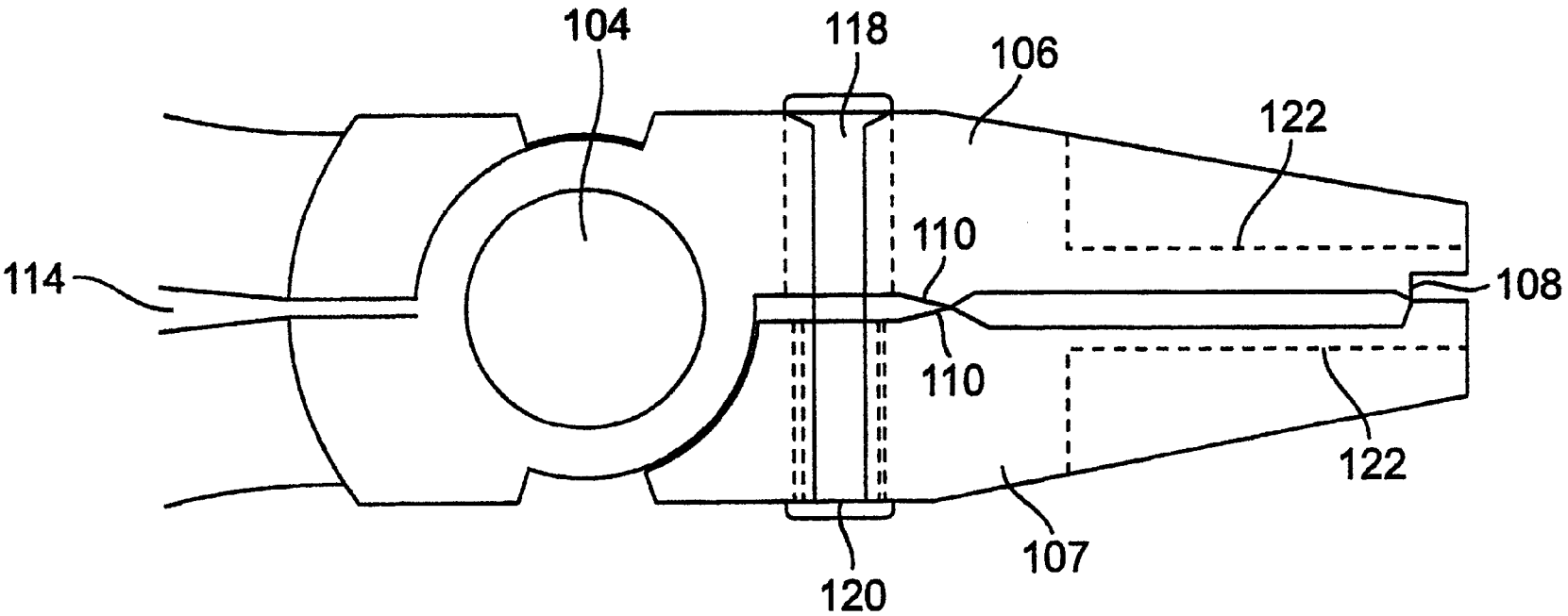
FIG. 3 is a top plan view of the jaws of the pin cutoff tool of FIG. 1.

The enlarged view of FIG. 3 illustrates additional, "hidden" features that may be included in the new pin cutoff tool. A channel 116 may be formed through the upper and lower jaws 106 to receive an opening stop, such as a bolt 118 and nut 120 combination, for example. In this illustrative embodiment, the bolt 118 and nut 120 do not engage with the sidewalls of the channel, thereby allowing the jaws to open and close. At the same time, the amount which the jaws may be opened may be determined by the nut and bolt arrangement, by virtue of engagement of the nut and of bolt's head with the jaws. Limiting the opening motion of the jaws in this manner prevents the jaws from opening so far as to come into contact with, and potentially damage, pins that are in close proximity to the pin that is targeted for cutting. Additionally, the jaws 106 may have channels 122 formed in them, as indicated by hidden lines in this view. The channels 122 accommodate the neighboring pins, allowing the neighboring pins to slip inside the channels as the cutoff tool is positioned over the pin of interest. At the same time, the channels permit the overall dimension of the jaws to remain relatively massive, thereby insuring that the jaws provide sufficient strength and rigidity for numerous pin cutting operations.

Figure 4:
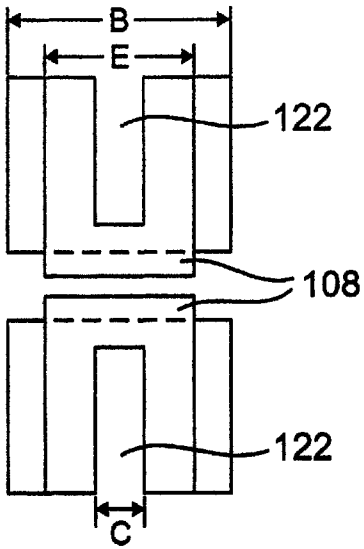
FIG. 4 is a front view of the jaws, illustrating the channels within the jaws, and the relatively narrow cross-section of the jaws, both of which features permit the cutoff tool to be inserted into an array of pins without disturbing pins that neighbor the pin that is to be cut.

Additionally, as illustrated in the front view of FIG. 4, the jaws 106 may, in order to further ease the tool's access to a pin that is to be cut, be formed narrower than the main body of the tool for some distance. The narrower section, having a width E, may, for example, be of a length which permits the shears 108 to reach a desired cutoff point on a pin which is to be cut, without interference with surrounding pins from the section of the jaws having a width B. Since the inter-pin spacing is typically standard and regular, a cutoff tool having a fixed width that is less than twice the inter-pin spacing will accommodate numerous pin-cutting applications. The width C of the channel 122 may be chosen such that a pin of the type being cut by the tool may be inserted in the channel.

Figure 5:
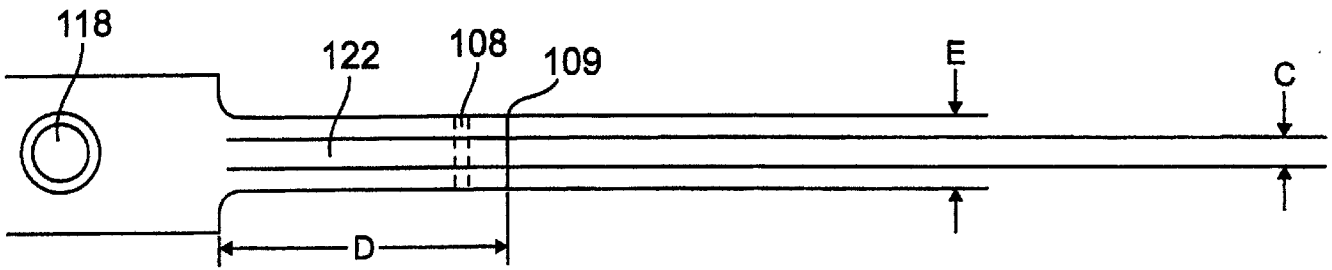
FIG. 5 is a top plan view that illustrates the channels and narrow width of the cutoff tools' jaws.

This configuration may be better understood with reference to the top plan view of FIG. 5 in which the jaws 106 have a narrower width E for a length D which is at least as long as the section of pin that is to be cut plus the length from the shearing member 108 to the tip of the tool 100. In an illustrative embodiment the distances C, D, and E are, respectively, 0.0400, 0.4800, and 0.1300 inches.

In accordance with the principles of the invention, a pin cutoff tool may be machined from a widely available set of pliers. This approach yields a relatively inexpensive, sufficiently hardened pin cutoff tool. One such set of pliers, widely available, is Diamond® /Xcelite® part number DN54G, five inch duckbill smooth jaw pliers, available from Cooper Tools, Post Office Box 728 Apex, N.C. 27502.

The foregoing description of specific embodiments of the invention has been presented for the purposes of illustration and description. It is not intended to be exhaustive or to limit the invention to the precise forms disclosed, and many modifications and variations are possible in light of the above teachings. The embodiments were chosen and described to best explain the principles of the invention and its practical application, and to thereby enable others skilled in the art to best utilize the invention. It is intended that the scope of the invention be limited only by the claims appended hereto.

What is claimed is:

1. A pin cutoff tool comprising:

jaws having inner surfaces with lateral shears formed on the inner surfaces at a predetermined distance from the tip of the jaws, the axis of the shears lateral shears are formed being in a direction that is orthogonal to the lengthwise axis of the cutoff tool, a pivot, and handles in working arrangement opposite the pivot from the jaws.

2. The pin cutoff tool of claim 1 further comprising:

resilient material applied to at least one of the inner surfaces of the jaws.

3. The pin cutoff tool of claim 2 wherein the resilient material includes an adhesive surface facing the interior of the jaws.

4. The pin cutoff tool of claim 2 further comprising closing stops formed within the jaws to limit the closing travel of the jaws.

5. The pin cutoff tool of claim 4 wherein the resilient material is of predetermined thickness to contact and embrace a pin when the jaws are closed as far as the closing stops permit.

6. The pin cutoff tool of claim 1 further comprising opening stops formed within the jaws to limit the opening travel of the jaws.

7. The pin cutoff tool of claim 5 further comprising an opening mechanism which opens the jaws as far as the opening stops will permit when the cutoff tool is at rest.

8. The pin cutoff tool of claim 7 wherein the opening mechanism is a captive spring situated between the handles of the cutoff tool in an orientation which forces the handles open in a resting position.

9. The pin cutoff tool of claim 1 further comprising channels formed within the jaws to accept one or more pins adjacent to a pin targeted for cutting.

10. The pin cutoff tool of claim 9 wherein the lateral shears are composed of steel of at least 55 Rockwell hardness.

11. A method of manufacturing a pin cutoff tool comprising the step of:

A) machining lateral shears on the interior surfaces of the jaws of pair of pliers composed of hardened steel, the shears located at a predetermined distance from the tip of the jaws corresponding to the targeted length of a pin stub left intact after operation of the shears.

12. The method of claim 11 further comprising the step of:

B) machining closing stops in the interior surfaces of the jaws, the closing stops being formed to limit the closing travel of the jaws to a position which permits the shearing of a pin, but which does not permit either shearing surface to strike the opposing surface of the jaws' interior.

13. The method of claim 12 further comprising the step of:

E) applying resilient material to at least one interior surface of the jaws, the resilient material being of predetermined thickness to contact and embrace a pin when the jaws are closed as far as the closing stops permit.

14. The method of claim 13 wherein the step E) of applying a resilient surface to the interior of the jaws further comprises the step of:

(E1) applying an adhesive surface to the interior of the jaws, the adhesive surface being formed to engage and retain a pin that has been sheared by the lateral shears.

15. The method of claim 11 further comprising the step of:

C) machining channels within the outer surfaces of the jaws, the channels formed to receive pins which neighbor a pin targeted for cutting.

16. The method of claim 15 further comprising the step of:

D) machining the jaws of the pin cutoff tool to a width that permits the insertion of the jaws between pins on either side of the pin targeted for cutting.

* * * * *